US009342003B2

(12) United States Patent
Suzuki et al.

(10) Patent No.: US 9,342,003 B2
(45) Date of Patent: May 17, 2016

(54) FIXING DEVICE FOR AN IMAGE FORMING APPARATUS INCLUDING A ROTATABLE DRIVER TO DEFINE A DRIVING SPAN IN AN AXIAL DIRECTION OF THE DRIVER

(71) Applicants: Akira Suzuki, Tokyo (JP); Takuya Seshita, Kanagawa (JP); Takeshi Yamamoto, Kanagawa (JP); Takahiro Imada, Kanagawa (JP); Hajime Gotoh, Kanagawa (JP)

(72) Inventors: Akira Suzuki, Tokyo (JP); Takuya Seshita, Kanagawa (JP); Takeshi Yamamoto, Kanagawa (JP); Takahiro Imada, Kanagawa (JP); Hajime Gotoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/618,845

(22) Filed: Feb. 10, 2015

(65) Prior Publication Data

US 2015/0253707 A1 Sep. 10, 2015

(30) Foreign Application Priority Data

Mar. 10, 2014 (JP) ..... 2014-046534

(51) Int. Cl.
*G03G 15/20* (2006.01)

(52) U.S. Cl.
CPC ..... *G03G 15/2053* (2013.01); *G03G 15/2089* (2013.01); *G03G 2215/2009* (2013.01); *G03G 2215/2035* (2013.01)

(58) Field of Classification Search
CPC ..... G03G 15/2053; G03G 15/2089; G03G 15/206; G03G 2215/2035
See application file for complete search history.

(56) References Cited

U.S. PATENT DOCUMENTS

| | | | | |
|---|---|---|---|---|
| 2005/0129431 | A1 | 6/2005 | Oohara et al. | |
| 2012/0163889 | A1* | 6/2012 | Koyama | G03G 15/2053 399/339 |
| 2012/0177423 | A1* | 7/2012 | Imada | G03G 15/2064 399/329 |
| 2012/0224896 | A1 | 9/2012 | Saitoh | |
| 2012/0308255 | A1* | 12/2012 | Sakai | G03G 15/2053 399/90 |
| 2013/0004218 | A1* | 1/2013 | Tsueda | G03G 15/2032 399/329 |
| 2014/0016972 | A1* | 1/2014 | Seshita | G03G 15/2064 399/329 |
| 2014/0255064 | A1 | 9/2014 | Suzuki et al. | |

FOREIGN PATENT DOCUMENTS

| | | |
|---|---|---|
| JP | 2004-045780 | 2/2004 |
| JP | 2005-173058 | 6/2005 |
| JP | 2007-279134 | 10/2007 |
| JP | 2007-279314 | 10/2007 |
| JP | 2008-200954 | 9/2008 |
| JP | 2010-160222 | 7/2010 |
| JP | 2012-181402 | 9/2012 |

* cited by examiner

*Primary Examiner* — David Gray
*Assistant Examiner* — Laura Roth
(74) *Attorney, Agent, or Firm* — Harness, Dickey & Pierce, P.L.C.

(57) ABSTRACT

A fixing device includes a rotatable, endless first belt and a rotatable, endless second belt contacting an outer circumferential surface of the first belt. A first nip formation pad contacts an inner circumferential surface of the first belt to form a fixing nip between the first belt and the second belt, through which a recording medium bearing a toner image is conveyed. A rotatable driver contacts an inner circumferential surface of the second belt to press against the first nip formation pad via the first belt and the second belt to frictionally drive and rotate the first belt and the second belt.

20 Claims, 7 Drawing Sheets

FIXING DEVICE FOR AN IMAGE FORMING APPARATUS INCLUDING A ROTATABLE DRIVER TO DEFINE A DRIVING SPAN IN AN AXIAL DIRECTION OF THE DRIVER

CROSS-REFERENCE TO RELATED APPLICATION

This patent application is based on and claims priority pursuant to 35 U.S.C. §119 to Japanese Patent Application No. 2014-046534, filed on Mar. 10, 2014, in the Japanese Patent Office, the entire disclosure of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

At least one embodiment provides a novel fixing device that includes a rotatable, endless first belt and a rotatable, endless second belt contacting an outer circumferential surface of the first belt. A first nip formation pad contacts an inner circumferential surface of the first belt to form a fixing nip between the first belt and the second belt, through which a recording medium bearing a toner image is conveyed. A rotatable driver contacts an inner circumferential surface of the second belt to press against the first nip formation pad via the first belt and the second belt to frictionally drive and rotate the first belt and the second belt.

At least one embodiment provides a novel image forming apparatus that includes an image forming device to form a toner image and a fixing device, disposed downstream from the image forming device in a recording medium conveyance direction, to fix the toner image on a recording medium. The fixing device includes a rotatable, endless first belt and a rotatable, endless second belt contacting an outer circumferential surface of the first belt. A first nip formation pad contacts an inner circumferential surface of the first belt to form a fixing nip between the first belt and the second belt, through which a recording medium bearing a toner image is conveyed. A rotatable driver contacts an inner circumferential surface of the second belt to press against the first nip formation pad via the first belt and the second belt to frictionally drive and rotate the first belt and the second belt.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
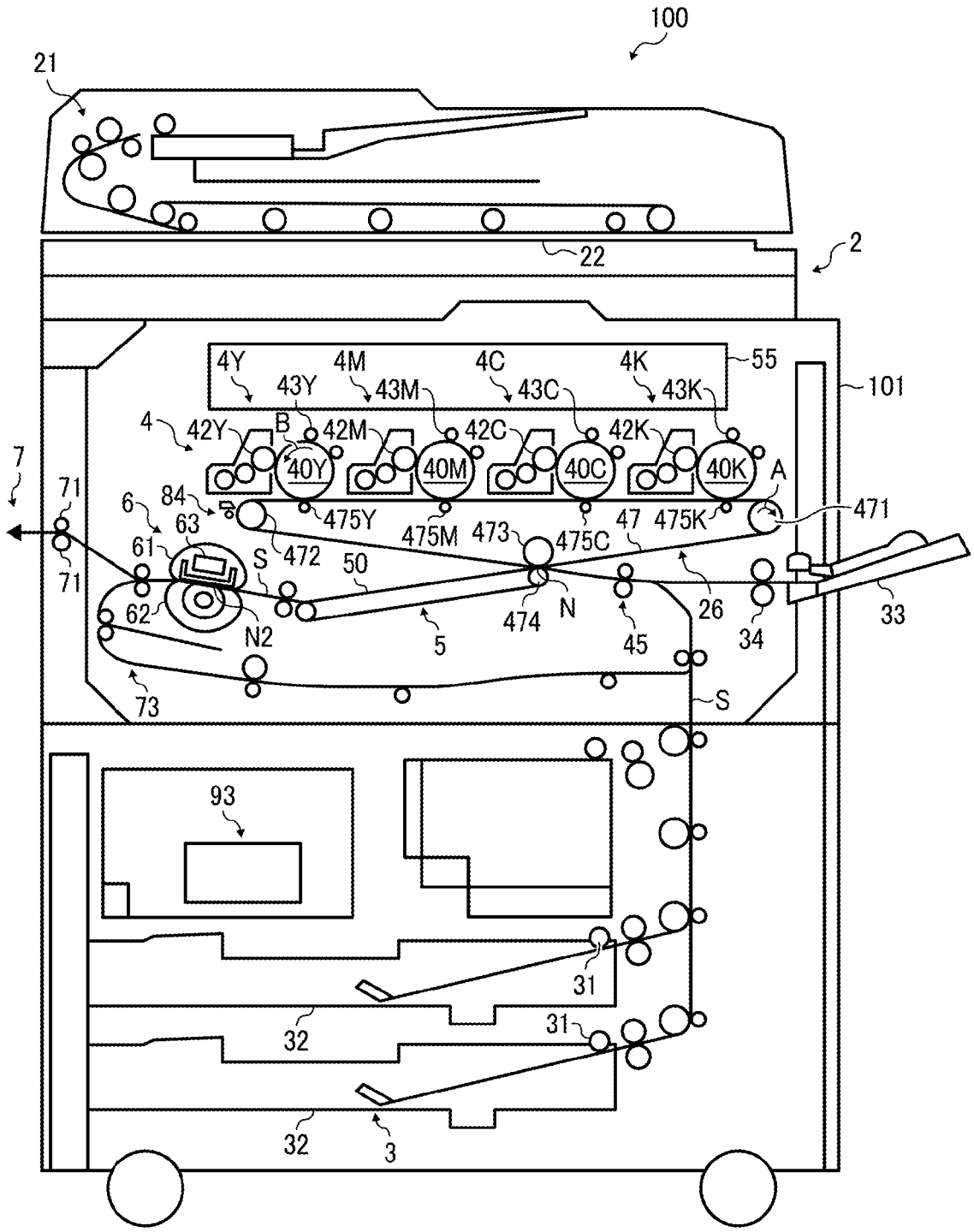
FIG. 1 is a schematic vertical sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

FIG. 1 is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 100 is a color copier that forms color and monochrome toner images on recording media by electrophotography. Alternatively, the image forming apparatus 100 may be a monochrome copier that forms monochrome toner images.

A description is provided of a construction of the image forming apparatus 100.

The image forming apparatus 100 forms a toner image on a sheet S serving as a recording medium by using toner serving as a recording agent to produce a copy and a print. As shown in FIG. 1, the image forming apparatus 100 includes an image forming device 4, constructed of four process units 4Y, 4M, 4C, and 4K, that forms a toner image on a sheet S and a sheet feeder 3 that supplies the sheet S to the image forming device 4.

Above the image forming device 4 are a reading device 2 serving as a scanner that reads an image on an original and an auto document feeder (ADF) 21 that automatically feeds the original to the reading device 2.

Inside a body 101 of the image forming apparatus 100 are a transfer unit 26, serving as a primary transferor including an endless, intermediate transfer belt 47 serving as a transfer body, that primarily transfers yellow, magenta, cyan, and black toner images formed by the process units 4Y, 4M, 4C, and 4K, respectively, onto the intermediate transfer belt 47 and an optical scanner 55 serving as an exposure device situated in proximity to the image forming device 4.

Below the transfer unit 26 is a transfer-convey device 5 serving as a secondary transferor that forms a secondary transfer nip N between the intermediate transfer belt 47 and a conveyance belt 50 of the transfer-convey device 5. As the transfer-convey device 5 conveys the sheet S through the secondary transfer nip N, the transfer-convey device 5 secondarily transfers the yellow, magenta, cyan, and black toner images from the intermediate transfer belt 47 onto the sheet S conveyed from the sheet feeder 3, thus forming a color toner image on the sheet S. An intermediate transfer belt cleaner 84 disposed opposite the intermediate transfer belt 47 cleans the intermediate transfer belt 47 after the secondary transfer of the toner images.

Upstream from the transfer-convey device 5 in a sheet conveyance direction is a registration roller pair 45 that conveys the sheet S supplied from the sheet feeder 3 to the secondary transfer nip N at a given time. Downstream from the transfer-convey device 5 in the sheet conveyance direction is a fixing device 6 that fixes the color toner image on the sheet S conveyed from the transfer-convey device 5.

Downstream from the fixing device 6 in the sheet conveyance direction is an output device 7 that outputs the sheet S bearing the fixed color toner image conveyed from the fixing device 6 onto an outside of the image forming apparatus 100.

An image formation controller 93 installed with a central processing unit (CPU), a non-volatile memory, and a volatile memory serves as a controller that controls an operation of the components described above used to form the color toner image on the sheet S.

A detailed description is now given of a configuration of the reading device 2.

The reading device 2 includes an exposure glass 22. As an original automatically conveyed by the ADF 21 moves over the exposure glass 22 or as an original is manually placed on the exposure glass 22, the reading device 2 optically reads an image on the original into red (R), green (G), and blue (B) image data. For example, the reading device 2 irradiates the original with light and a charge coupled device (CCD) or a reading sensor such as a contact image sensor (CIS) receives the light reflected by the original into RGB image data. RGB image data is information defining a toner image to be formed on a sheet S and including the luminosity of each of red (R), green (G), and blue (B).

A detailed description is now given of a construction of the sheet feeder 3.

The sheet feeder 3 includes a plurality of paper trays 32 located inside the body 101 to load a plurality of sheets S and a plurality of feed rollers 31 that feeds a sheet S from the plurality of paper trays 32, respectively, to the registration roller pair 45. The sheet feeder 3 further includes a bypass tray 33 serving as a bypass sheet feeder situated outside the body 101 to load and supply one or more sheets S and a bypass feed roller 34 that feeds a sheet S from the bypass tray 33 to the registration roller pair 45.

A detailed description is now given of a construction of the process units 4Y, 4M, 4C, and 4K.

The process units 4Y, 4M, 4C, and 4K include drum-shaped photoconductors 40Y, 40M, 40C, and 40K, chargers 43Y, 43M, 43C, and 43K, developing devices 42Y, 42M, 42C, and 42K, and primary transfer rollers 475Y, 475M, 475C, and 475M, respectively.

Each of the photoconductors 40Y, 40M, 40C, and 40K is an image bearer or a rotator rotatable counterclockwise in FIG. 1 in a rotation direction B. Each of the photoconductors 40Y, 40M, 40C, and 40K includes a surface photosensitive layer scanned and irradiated with light from the optical scanner 55 to form an electrostatic latent image. The chargers 43Y, 43M, 43C, and 43K are disposed opposite the photoconductors 40Y, 40M, 40C, and 40K and upstream from the developing devices 42Y, 42M, 42C, and 42K, respectively, in the rotation direction B of the photoconductors 40Y, 40M, 40C, and 40K to charge an outer circumferential surface of the respective photoconductors 40Y, 40M, 40C, and 40K. The developing devices 42Y, 42M, 42C, and 42K develop the electrostatic latent images formed on the photoconductors 40Y, 40M, 40C, and 40K into yellow, magenta, cyan, and black toner images, respectively. The primary transfer rollers 475Y, 475M, 475C, and 475K accommodated in the transfer unit 26 serve as primary transferors that primarily transfer the yellow, magenta, cyan, and black toner images formed on the photoconductors 40Y, 40M, 40C, and 40K, respectively, onto the intermediate transfer belt 47.

Each of the process units 4Y, 4M, 4C, and 4K further includes an electric potential sensor, for example, a surface electric potential sensor, serving as a surface electric potential detector that detects the surface electric potential of the respective photoconductors 40Y, 40M, 40C, and 40K. Thus, the process units 4Y, 4M, 4C, and 4K visualize the electrostatic latent images formed on the photoconductors 40Y, 40M, 40C, and 40K by the optical scanner 55 into the yellow, magenta, cyan, and black toner images, respectively.

A detailed description is now given of a configuration of the intermediate transfer belt 47.

The intermediate transfer belt 47 is made of polyimide resin having a decreased elongation that is dispersed with carbon powder to adjust the electric resistance. The intermediate transfer belt 47 is looped over a driving roller 471 that is driven and rotated by a driver clockwise in FIG. 1 in a rotation direction A to drive and rotate the intermediate transfer belt 47 and a driven roller 472 and a secondary transfer roller 473 that are driven and rotated clockwise in FIG. 1 in a rotation direction identical to the rotation direction A of the driving roller 471 by the intermediate transfer belt 47.

A detailed description is now given of a configuration of the transfer-convey device 5.

The transfer-convey device 5 includes a secondary transfer opposed roller 474 disposed opposite the secondary transfer roller 473. The secondary transfer opposed roller 474 presses against the intermediate transfer belt 47 via the conveyance belt 50 at the secondary transfer nip N. As the secondary transfer opposed roller 474 and the secondary transfer roller 473 sandwich the intermediate transfer belt 47 and the sheet S at the secondary transfer nip N, the transfer-convey device 5 secondarily transfers the yellow, magenta, cyan, and black toner images formed on an outer circumferential surface of the intermediate transfer belt 47 onto the sheet S under a secondary transfer bias. The secondary transfer bias has an electric charge opposite an electrostatic charge that charges the outer circumferential surface of the intermediate transfer belt 47.

A detailed description is now given of a configuration of the output device 7.

The output device 7 includes an output roller pair 71 constructed of two opposed rollers and a duplex unit 73 that reverses the sheet S ejected from the fixing device 6 and conveys the sheet S to the registration roller pair 45 for duplex printing.

A detailed description is now given of a configuration of the image formation controller 93.

The image formation controller 93 includes a central processing unit (CPU), a main memory (MEM-P), a north bridge (NB), a south bridge (SB), an accelerated graphics port (AGP) bus, an application specific integrated circuit (ASIC), a local memory (MEM-C), a hard disk (HD), a hard disk drive (HDD), a peripheral component interconnect (PCI) bus, and a network interface (I/F).

The CPU performs data processing and calculation according to a program stored in the main memory and controls an operation of the components of the image forming apparatus 100 described above. The main memory is a storage region of the image formation controller 93 that stores a program and data actuating various functions of the image formation controller 93. Alternatively, the program may be stored in a computer readable, recording medium, such as a compact disc read only memory (CD-ROM), a floppy disk (FD), a compact disc recordable (CD-R), and a digital versatile disc (DVD), in a file format installable or executable.

The local memory (MEM-C) is used as an image buffer for copying and a code buffer. The HD is a storage that stores image data, font data used for printing, and form data. The HDD controls reading or writing of data with respect to the HD under control of the CPU. The network I/F sends and receives data to and from an external device such as a data processor via a communication network.

The image formation controller 93 serves as a communication controller that controls bidirectional communication with a host device (e.g., a client computer) via the communication network or the like. The image formation controller 93 also serves as an image data processor that sends image data from the host device to the optical scanner 55.

A detailed description is now given of a construction of the fixing device 6 according to a first example embodiment.

The fixing device 6 (e.g., a fuser or a fusing unit) includes an endless, first fixing member 61 serving as a first belt that conveys the sheet S; an endless, second fixing member 62 serving as a second belt contacting an outer circumferential surface of the first fixing member 61 to form a fixing nip N2; and a heater 63 that heats the first fixing member 61 so that the first fixing member 61 melts and fixes the toner image on the sheet S.

Figure 2:
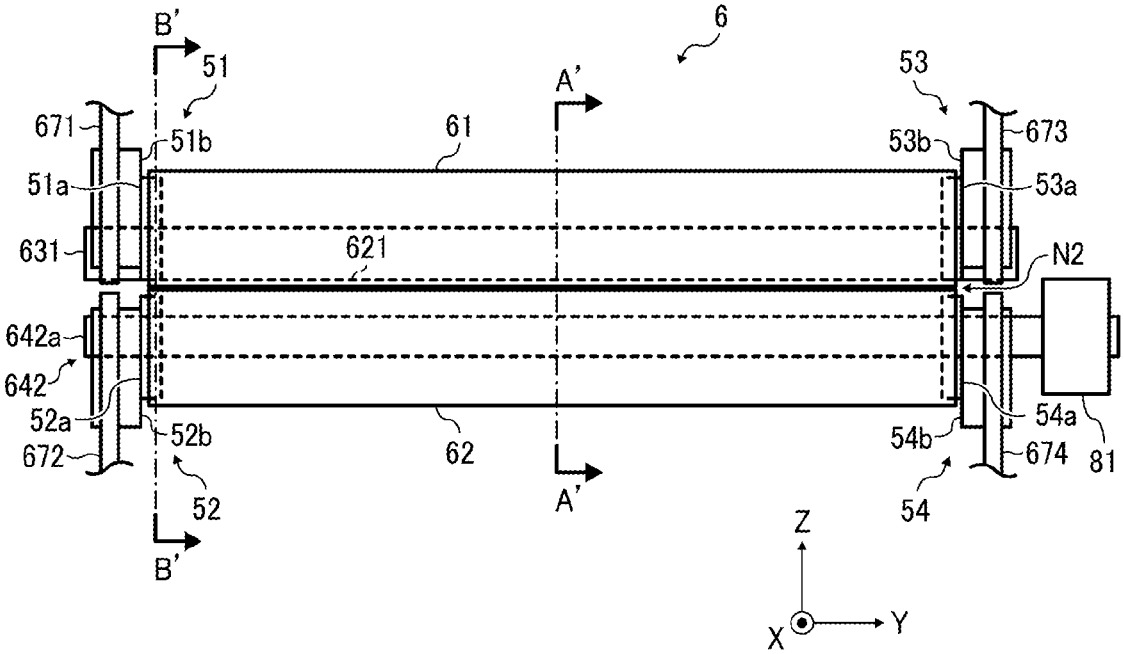
FIG. 2 is a schematic side view of a fixing device according to a first example embodiment incorporated in the image forming apparatus shown in FIG. 1.
Figure 3:
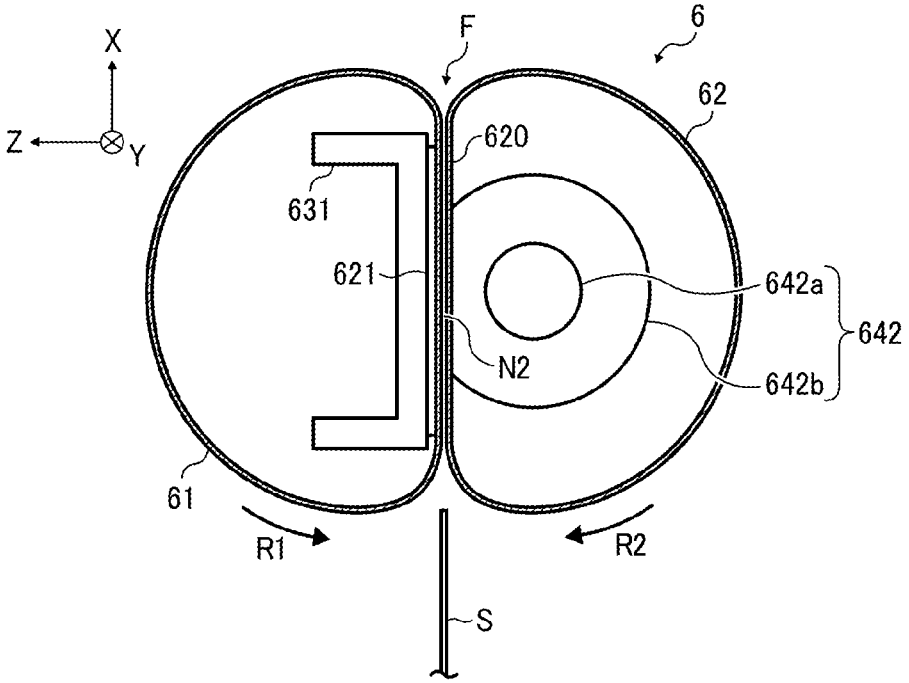
FIG. 3 is a vertical sectional view of the fixing device taken along line A'-A' in FIG. 2.

With reference to FIGS. 2 and 3, a description is provided of the construction of the fixing device 6 in more detail.

FIG. 2 is a schematic side view of the fixing device 6. In FIG. 2, a direction X defines the sheet conveyance direction in which the sheet S is conveyed through the fixing device 6. A direction Y defines an axial direction of the first fixing member 61 and the second fixing member 62. A direction Z defines a direction perpendicular to the directions X and Y.

As shown in FIG. 2, the fixing device 6 further includes a first nip formation pad 621, a driver 642, a first support 631, first end flanges 51 and 53, second end flanges 52 and 54, first frames 671 and 673, second frames 672 and 674, and a driving gear 81.

The first nip formation pad 621 serves as a first nip formation member that contacts an inner circumferential surface of the first fixing member 61. The driver 642, contacting an inner circumferential surface of the second fixing member 62, frictionally drives and rotates the first fixing member 61 and the second fixing member 62. The first support 631, disposed opposite the inner circumferential surface of the first fixing member 61 at the fixing nip N2, contacts and supports the first nip formation pad 621. The first end flanges 51 and 53, over which the first fixing member 61 is looped, support the first fixing member 61 at both lateral ends of the first fixing member 61 in the axial direction thereof, that is, the direction Y. The second end flanges 52 and 54, over which the second fixing member 62 is looped, support the second fixing member 62 at both lateral ends of the second fixing member 62 in the axial direction thereof, that is, the direction Y. The first frames 671 and 673, mounted on a casing of the fixing device 6, mount the first end flanges 51 and 53, respectively. The second frames 672 and 674, mounted on the casing of the fixing device 6, mount the second end flanges 52 and 54, respectively.

The fixing device 6 further includes a motor serving as a driving source that drives and rotates the driver 642. The driving gear 81 is driven by the motor.

FIG. 3 is a vertical sectional view of the fixing device 6 taken along line A'-A' in FIG. 2. As shown in FIG. 3, as the sheet S bearing the toner image is conveyed through the fixing nip N2, the first fixing member 61 and the second fixing member 62 fix the toner image on the sheet S under heat and pressure.

A detailed description is now given of a configuration of the first fixing member 61.

The first fixing member 61 serving as a fixing rotator or a first belt is a flexible, multilayered endless belt. If the first fixing member 61 is circular in cross-section on a plane defined by the directions X and Z, the first fixing member 61 has a loop diameter of about 30 mm and a thickness of about 0.2 mm. The first fixing member 61 is constructed of an innermost base layer, an elastic layer coating the base layer, and an outermost surface layer. The base layer is a rigid metal layer made of aluminum. The elastic layer made of silicone rubber, as it is deformed elastically to conform to surface asperities of the sheet S, stabilizes application of heat and pressure from the first fixing member 61 to the sheet S. The surface layer, made of tetrafluoroethylene-perfluoroalkylvinylether copolymer (PFA), facilitates stable separation of toner and the sheet S from the first fixing member 61.

The base layer is made of metal such as stainless steel and nickel to enhance the rigidity of the first fixing member 61. Alternatively, the base layer may be made of heat resistant resin such as polyimide. The elastic layer may be made of an elastic body such as rubber. The surface layer may be made of polytetrafluoroethylene (PTFE), polyimide, polyetherimide, polyether sulfone (PES), or the like. If it is allowed to ignore surface asperities of the sheet S and improvement in fixing quality, the first fixing member 61 may be a bilayer constructed of the base layer and the surface layer, not incorporating the elastic layer. If the first fixing member 61 is circular in cross-section on the plane defined by the directions X and Z, the first fixing member 61 may have an arbitrary loop diameter in a range of from about 15 mm to about 300 mm.

A detailed description is now given of a configuration of the second fixing member 62.

The second fixing member 62 serving as a second belt is an endless belt disposed opposite the first fixing member 61 to form the fixing nip N2. The second fixing member 62 mounts a friction resistance portion 620 constituting a contact face that contacts the driver 642. The friction resistance portion 620 increases a maximum static friction. The friction resistance portion 620 is a face produced by partially or entirely increasing the roughness of the contact face thereof that contacts the driver 642 to increase the maximum static friction relative to a normal roughness of a base layer. Accordingly, the friction resistance portion 620 transmits a driving torque, that is, a rotation force, of the driver 642 to the second fixing member 62 to rotate the second fixing member 62 effectively.

In order to increase the maximum static friction between the driver 642 and the friction resistance portion 620, an inner surface of the base layer serving as an innermost layer of the second fixing member 62 may be adhered with a material different from that of the base layer, for example, a rubber member. Alternatively, in order to increase the maximum static friction between the driver 642 and the friction resistance portion 620, the friction resistance portion 620 may coat the inner surface of the base layer. Accordingly, the friction resistance portion 620 increases the maximum static friction to transmit the driving torque from the driver 642 to the second fixing member 62 more effectively compared to a portion of the second fixing member 62 not provided with the friction resistance portion 620.

Other materials and the like of the second fixing member 62 are equivalent to those of the first fixing member 61 and therefore a description thereof is omitted.

A detailed description is now given of a configuration of the heater 63.

As shown in FIG. 1, the heater 63 is a radiation heater serving as a heat generator that generates heat to be conducted to the toner image on the sheet S conveyed through the fixing nip N2. The heater 63 also serves as a heat source that heats the sheet S and the unfixed toner image on the sheet S through the first fixing member 61 or the second fixing member 62. Alternatively, the heater 63 may be a resistance heat generator or an induction heater instead of the radiation heater. If the heater 63 is an induction heater including an induction heater (IH) coil employing an electromagnetic induction heating method, the first fixing member 61 or the second fixing member 62 may incorporate a conductive, heating layer made of copper that generates heat by electromagnetic induction. Alternatively, the heating layer may be made of iron or the like as long as it generates heat by electromagnetic induction. Yet alternatively, the heater 63 may be a halogen heater disposed inside the driver 642.

A detailed description is now given of a configuration of the first nip formation pad 621.

As shown in FIG. 3, the first nip formation pad 621 serves as a fixing nip formation member situated inside a loop formed by the first fixing member 61 and in contact with the inner circumferential surface of the first fixing member 61 to form the fixing nip N2 between the first fixing member 61 and the second fixing member 62. The first nip formation pad 621 is made of liquid crystal polymer (LCP) and substantially platy.

As shown in FIG. 2, as the first frames 671 and 673 are displaced as descried below, the first nip formation pad 621 in contact with the inner circumferential surface of the first fixing member 61 presses the first fixing member 61 against the second fixing member 62 in a direction opposite the direction Z so that the first fixing member 61 and the second fixing member 62 sandwich and press the sheet S. A hardness of a contact face of the first nip formation pad 621 that contacts the first fixing member 61 is greater than a hardness of a surface of the driver 642. The first nip formation pad 621 changes the shape of the first fixing member 61, the second fixing member 62, and the driver 642 in conformity with the shape of the first nip formation pad 621. By changing the shape of the first nip formation pad 621, the fixing nip N2 having desired shape and pressure distribution is produced.

Alternatively, a sheet having a decreased friction coefficient may be wound around a surface of the first nip formation pad 621 or a material having a decreased friction coefficient may coat a slide face of the first nip formation pad 621 over which the first fixing member 61 slides to produce a slide layer that reduces a friction between the first nip formation pad 621 and the first fixing member 61 sliding thereover. The first nip formation pad 621 may be made of heat resistant resin such as polyimide and polyamide imide (PAI).

A detailed description is now given of a construction of the driver 642.

As shown in FIG. 3, the driver 642 includes a cored bar 642*a* made of metal and an elastic layer 642*b* made of silicone rubber. As the cored bar 642*a* is rotated by the driving gear 81 mounted thereon, the driver 642 drives and rotates the second fixing member 62 in a rotation direction R2, thus driving and rotating the first fixing member 61 in a rotation direction R1 by pressure and friction between the first fixing member 61 and the second fixing member 62 at the fixing nip N2. The elastic layer 642*b* of the driver 642 is deformed by a reaction force generated as it is pressed against the first nip formation pad 621 in conformity with the shape of the contact face of the first nip formation pad 621 that contacts the first fixing member 61, thus pressing against the second fixing member 62.

A detailed description is now given of a configuration of the first support 631.

The first support 631 has a rigidity great enough to prevent or suppress deformation of the first nip formation pad 621 that may appear as the first nip formation pad 621 receives the reaction force from the fixing nip N2. For example, the first support 631 is made of stainless steel. Alternatively, the first support 631 may be made of metal such as iron. The first support 631 supporting the first nip formation pad 621 in conformity with the shape of the first nip formation pad 621 serves as a fixing nip formation aid that prevents or suppresses deformation of the first nip formation pad 621.

Figure 4:
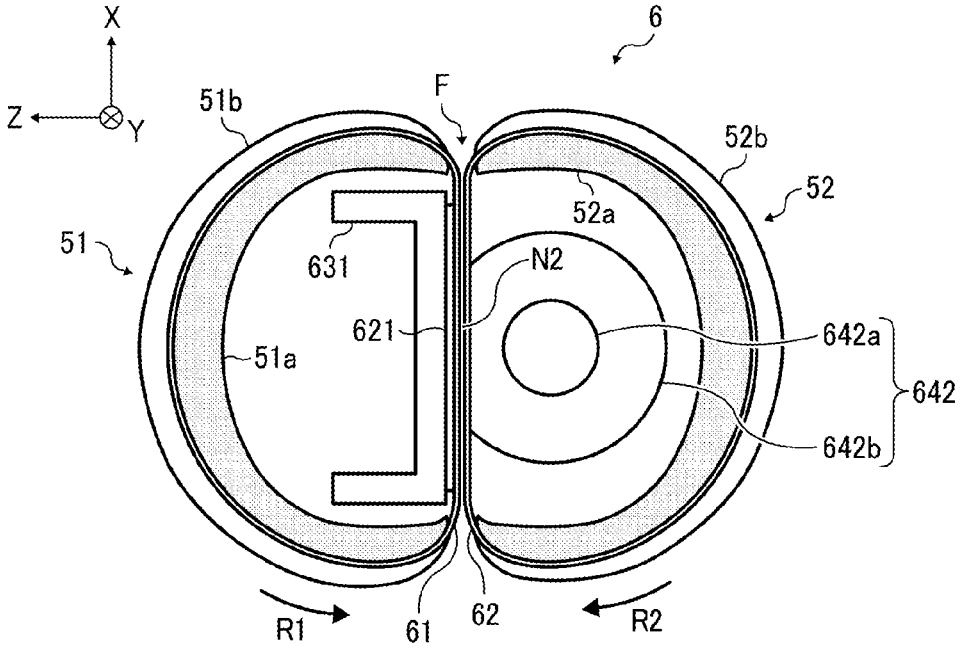
FIG. 4 is a vertical sectional view of the fixing device taken along line B'-B' in FIG. 2.

With reference to FIG. 4, a description is provided of a construction of the first end flange 51 and the second end flange 52.

FIG. 4 is a vertical sectional view of the fixing device 6 taken along line B'-B' in FIG. 2. Since the first end flange 53 and the second end flange 54 are symmetrical to the first end flange 51 and the second end flange 52, respectively, and therefore a construction of the first end flange 53 and the second end flange 54 is equivalent to that of the first end flange 51 and the second end flange 52, a description of the construction of the first end flange 53 and the second end flange 54 is omitted.

As shown in FIG. 4, the first end flange 51 includes a belt support 51*a* and a belt stopper 51*b*. The belt support 51*a* is inserted into the loop formed by the first fixing member 61 and disposed opposite the inner circumferential surface of the first fixing member 61. The belt stopper 51*b* is disposed opposite a lateral edge face of the first fixing member 61 in the direction Y to prevent the first fixing member 61 from being skewed.

Similarly, as shown in FIG. 2, the first end flange 53 includes a belt support 53*a* and a belt stopper 53*b*.

As shown in FIG. 4, the belt support 51*a* is loosely fitted to the loop formed by the first fixing member 61 to contact and support the inner circumferential surface of the first fixing member 61. The belt support 51*a* retains the shape of the first fixing member 61 with a balance between the shape of an outer circumference of the belt support 51*a* and the rigidity of the first fixing member 61. The belt support 51*a* has a shape that increases the curvature of the first fixing member 61 at a position in proximity to an exit F of the fixing nip N2 as the belt support 51*a* supports the first fixing member 61, thus serving as a separation aid that facilitates separation of the sheet S ejected from the fixing nip N2 in the direction X from the first fixing member 61.

If the first fixing member 61 is skewed in the direction Y in accordance with rotation of the first fixing member 61, the lateral edge face of the first fixing member 61 comes into contact with the belt stopper 51*b*. Thus, the belt stopper 51*b* restricts movement of the first fixing member 61 in the direction Y.

Similarly, the second end flange 52 includes a belt support 52*a* and a belt stopper 52*b*. The belt support 52*a* is inserted into a loop formed by the second fixing member 62 and disposed opposite the inner circumferential surface of the second fixing member 62. The belt stopper 52*b* is disposed opposite a lateral edge face of the second fixing member 62 in the direction Y to prevent the second fixing member 62 from being skewed.

Similarly, as shown in FIG. 2, the second end flange 54 includes a belt support 54*a* and a belt stopper 54*b*.

As shown in FIG. 4, the belt support 52*a* is loosely fitted to the loop formed by the second fixing member 62 to contact and support the inner circumferential surface of the second fixing member 62. The belt support 52*a* retains the shape of the second fixing member 62 with a balance between the shape of an outer circumference of the belt support 52*a* and the rigidity of the second fixing member 62. The belt support 52*a* has a shape that increases the curvature of the second fixing member 62 at a position in proximity to the exit F of the fixing nip N2 as the belt support 52*a* supports the second fixing member 62, thus serving as a separation aid that facilitates separation of the sheet S ejected from the fixing nip N2 in the direction X from the second fixing member 62. If the second fixing member 62 is skewed in the direction Y in accordance with rotation of the second fixing member 62, the lateral edge face of the second fixing member 62 comes into contact with the belt stopper 52*b*. Thus, the belt stopper 52*b* restricts movement of the second fixing member 62 in the direction Y.

A description is provided of a configuration of the first frames 671 and 673.

As shown in FIG. 2, the first frames 671 and 673 mount and support the first end flanges 51 and 53, respectively. The first frames 671 and 673 also mount and support the first support 631 at each lateral end thereof in the direction Y. An end of each of the first frames 671 and 673 is connected to the body 101 of the image forming apparatus 100 depicted in FIG. 1. The body 101 supports the first frames 671 and 673 such that the first frames 671 and 673 are movable in the direction Z by a driver. As the driver moves the first frames 671 and 673 toward the second frames 672 and 674, respectively, the first fixing member 61 supported by the first frames 671 and 673 through the first end flanges 51 and 53, respectively, comes into contact with the second fixing member 62. As the first frames 671 and 673 adjust displacement of the first fixing member 61 with respect to the second fixing member 62, the first frames 671 and 673 adjust pressure between the first fixing member 61 and the second fixing member 62 at the fixing nip N2.

A description is provided of a configuration of the second frames 672 and 674.

As shown in FIG. 2, the second frames 672 and 674 mount and support the second end flanges 52 and 54, respectively. The second frames 672 and 674 also rotatably support the cored bar 642*a* of the driver 642 at each lateral end of the cored bar 642*a* in the direction Y. An end of each of the second frames 672 and 674 is mounted on the casing of the fixing device 6.

As described above, the first frames 671 and 673 are movable. Alternatively, the second frames 672 and 674 may be movable or both the first frames 671 and 673 and the second frames 672 and 674 may be movable. Further, displacement of the first frames 671 and 673 may be adjusted by an eccentric cam or the like.

A description is provided of a copy job performed by the image forming apparatus 100 having the construction described above.

As shown in FIG. 1, a user sets an original on the ADF 21 and presses a start button on a control panel. Alternatively, the user lifts the ADF 21, places an original on the exposure glass 22, lowers the ADF 21 to cause the ADF 21 to press the original against the exposure glass 22, and presses the start button on the control panel. For example, the user sets a sheaf of original sheets on the ADF 21 or places a single-side binding booklet on the exposure glass 22. If the image forming apparatus 100 is used as a printer, the user selects image data for a print job in an external device such as a client computer connected to the image forming apparatus 100 and inputs an instruction to start the print job.

If the user sets an original of a copy job on the ADF 21, the reading device 2 reads an image on the original sent out from the ADF 21 onto the exposure glass 22. If the user places an original of a copy job on the exposure glass 22, the reading device 2 reads an image on the original when the user presses the start button on the control panel. As the reading device 2 reads the image on the original, the image formation controller 93 serving as an image data processor generates RGB image data corresponding to yellow, magenta, cyan, and black image data.

Based on the RGB image data generated or input, the image formation controller 93 produces a toner pattern used to form each of yellow, magenta, cyan, and black toner images.

The image forming device 4 forms the yellow, magenta, cyan, and black toner images by using the toner patterns. The process units 4Y, 4M, 4C, and 4K perform the image forming operation described above, forming the yellow, magenta, cyan, and black toner images on the intermediate transfer belt 47. For example, in the process units 4Y, 4M, 4C, and 4K, the chargers 43Y, 43M, 43C, and 43K uniformly charge the photoconductors 40Y, 40M, 40C, and 40K, respectively. Thereafter, the optical scanner 55 scans and exposes the outer circumferential surface of the respective photoconductors 40Y, 40M, 40C, and 40K according to the RGB image data, forming electrostatic latent images on the scanned outer circumferential surface of the respective photoconductors 40Y, 40M, 40C, and 40K.

The developing devices 42Y, 42M, 42C, and 42K develop and visualize the electrostatic latent images on the photoconductors 40Y, 40M, 40C, and 40K with yellow, magenta, cyan, and black toners carried by a developing roller of the respective developing devices 42Y, 42M, 42C, and 42K into yellow, magenta, cyan, and black toner images, respectively. The primary transfer rollers 475Y, 475M, 475C, and 475K primarily transfer the yellow, magenta, cyan, and black toner images formed on the photoconductors 40Y, 40M, 40C, and 40K onto the intermediate transfer belt 47 driven and rotated clockwise in FIG. 1 such that the yellow, magenta, cyan, and black toner images are superimposed successively on the intermediate transfer belt 47. The yellow, magenta, cyan, and black toner images formed on the photoconductors 40Y, 40M, 40C, and 40K are primarily transferred from the upstream photoconductor 40Y to the downstream photoconductor 40K in a rotation direction of the intermediate transfer belt 47 at different times so that the yellow, magenta, cyan, and black toner images are superimposed on a same position on the intermediate transfer belt 47. After the primary transfer of the yellow, magenta, cyan, and black toner images, a cleaner of the respective process units 4Y, 4M, 4C, and 4K cleans the outer circumferential surface of the respective photoconductors 40Y, 40M, 40C, and 40K, rendering the photoconductors 40Y, 40M, 40C, and 40K to be ready for a next job. Yellow, magenta, cyan, and black toners contained in toner cartridges are supplied to the developing devices 42Y, 42M, 42C, and 42K of the process units 4Y, 4M, 4C, and 4K through conveyance tubes, respectively, in a given amount as needed.

The yellow, magenta, cyan, and black toner images superimposed on the intermediate transfer belt 47 reach the secondary transfer nip N where the secondary transfer roller 473 is disposed opposite the secondary transfer opposed roller 474 in accordance with rotation of the intermediate transfer belt 47. At the secondary transfer nip N, the secondary transfer roller 473 and the secondary transfer opposed roller 474 secondarily transfer the yellow, magenta, cyan, and black toner images from the intermediate transfer belt 47 onto a sheet S, forming a color toner image on the sheet S. For example, the secondary transfer opposed roller 474 is applied with a voltage having a positive polarity opposite a negative polarity of the charged toners to attract the negatively charged toners, thus secondarily transferring the yellow, magenta, cyan, and black toner images onto the sheet S.

When the user presses the start button on the control panel, the feed roller 31 of the sheet feeder 3 rotates to pick up and feed a sheet S from the paper tray 32 to the secondary transfer nip N formed between the intermediate transfer belt 47 and the conveyance belt 50. As a driver rotates the feed roller 31, the feed roller 31 feeds a sheet S from the paper tray 32. The sheet S is conveyed to the registration roller pair 45 through a plurality of feed rollers located between the feed roller 31 and the registration roller pair 45. The registration roller pair 45 feeds the sheet S to the secondary transfer nip N at a time when a leading edge of the color toner image formed by the superimposed yellow, magenta, cyan, and black toner images on the intermediate transfer belt 47 reaches the secondary transfer nip N based on a detection signal output by a sensor. Such feeding of the sheet S starts substantially in synchronism with start of reading of the reading device 2 described above.

The sheet S being transferred with the yellow, magenta, cyan, and black toner images and therefore bearing the color toner image enters the fixing device 6. As shown in FIG. 2, as the sheet S is conveyed through the fixing nip N2 formed between the first fixing member 61 and the second fixing member 62, the image formation controller 93 controls the motor to drive the driving gear 81, rotating the driver 642 mounting the driving gear 81.

As shown in FIG. 3, the driver 642, together with the first nip formation pad 621, sandwiches the first fixing member 61 and the second fixing member 62 and drives and rotates the second fixing member 62 which in turn rotates the first fixing member 61, thus causing the first fixing member 61 and the second fixing member 62 to convey the sheet S in the direction X. The first fixing member 61 and the second fixing member 62 press the sheet S with pressure exerted by the first nip formation pad 621 and the driver 642 that sandwich the first fixing member 61 and the second fixing member 62.

As shown in FIG. 1, the heater 63 heats the first fixing member 61 and the second fixing member 62 which in turn heat the sheet S. As the sheet S is conveyed through the fixing nip N2, the first fixing member 61 and the second fixing member 62 fix the color toner image on the sheet S under heat and pressure, forming the high quality color toner image on the sheet S. A separation claw guides the sheet S bearing the fixed color toner image to the output roller pair 71 which ejects the sheet S onto the outside of the image forming apparatus 100 or to the duplex unit 73 where the sheet S is ready for duplex printing.

For example, the output roller pair 71 ejects the sheet S bearing the fixed color toner image onto an output tray which stacks the sheet S.

A cleaner removes residual toner or the like failed to be primarily transferred onto the intermediate transfer belt 47 and therefore remaining on the respective photoconductors 40Y, 40M, 40C, and 40K therefrom, cleaning the photoconductors 40Y, 40M, 40C, and 40K for the next job. The intermediate transfer belt cleaner 84 removes residual toner failed to be secondarily transferred onto the sheet S and therefore remaining on the intermediate transfer belt 47 therefrom, cleaning the intermediate transfer belt 47 for the next job.

As shown in FIG. 2, the fixing nip N2 has an increased length in the direction X to allow the first fixing member 61 and the second fixing member 62 to apply heat and pressure to toner of the toner image on the sheet S sufficiently. The fixing nip N2 is substantially planar to prevent the sheet S conveyed through the fixing nip N2 from being bent or skewed due to a difference in radius of curvature between the first fixing member 61 or the second fixing member 62 and the sheet S such as an envelope constructed of a plurality of layers of paper. As shown in FIG. 3, the first fixing member 61 or the second fixing member 62 has an increased curvature at a position in proximity to the exit F of the fixing nip N2 to facilitate separation of the sheet S ejected from the fixing nip N2 from the first fixing member 61 or the second fixing member 62.

In a comparative fixing device including a pair of endless belts that forms a fixing nip and a plurality of pressurization members that sandwiches the pair of endless belts at the fixing nip, as the endless belts frictionally slide over the pressurization members, respectively, friction between the endless belt and the pressurization member may increase a driving torque that drives and rotates the endless belt. To address this circumstance, the endless belt may be applied with tension to enhance efficiency in transmitting the driving torque or a plurality of drivers may attain the driving torque. However, those methods may decrease the life of the endless belt, increase the number of driving parts which increase manufacturing costs, and increase deformation of the endless belt. To address this circumstance, the driver 642, together with the first nip formation pad 621, sandwiches the first fixing member 61 and the second fixing member 62 and drives and rotates the second fixing member 62 and the first fixing member 61. Accordingly, with the simple, single driver 642, the fixing device 6 prevents warping and creasing of the second fixing member 62, achieving stable conveyance of the sheet S. Additionally, the second fixing member 62 is not applied with tension unnecessarily, preventing or suppressing the decreased life of the second fixing member 62.

The second fixing member 62 mounts the friction resistance portion 620 constituting the contact face that contacts the driver 642. The friction resistance portion 620 increases the maximum static friction. Accordingly, the friction resistance portion 620 increases the maximum static friction to transmit the driving torque from the driver 642 to the second fixing member 62 more effectively compared to a portion of the second fixing member 62 not provided with the friction resistance portion 620.

A description is provided of a construction of a fixing device 6S according to a second example embodiment.

Figure 5:
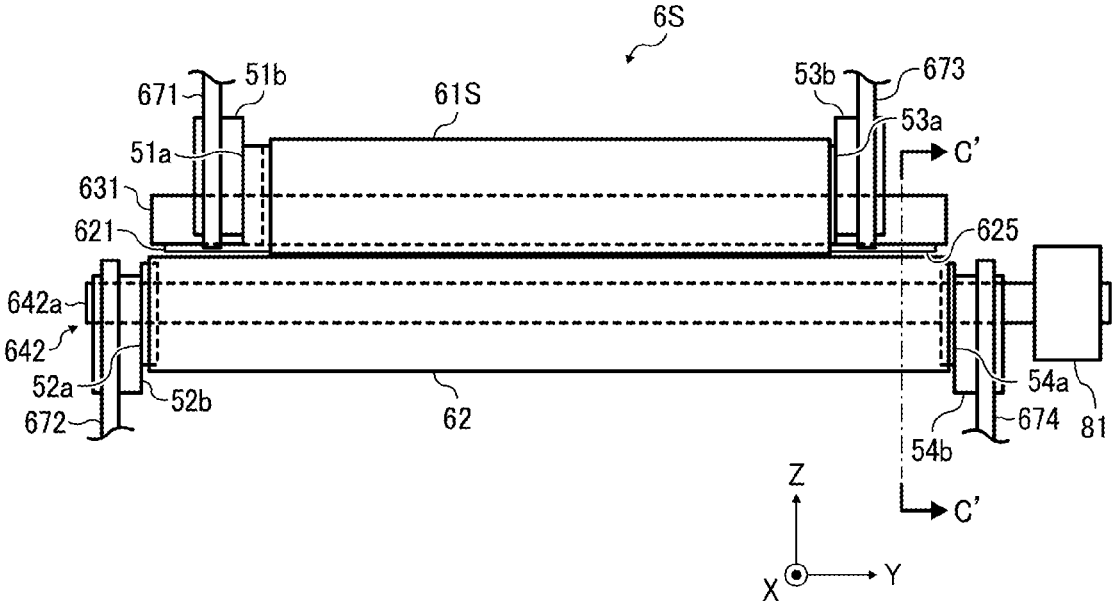
FIG. 5 is a schematic side view of a fixing device according to a second example embodiment.
Figure 6:
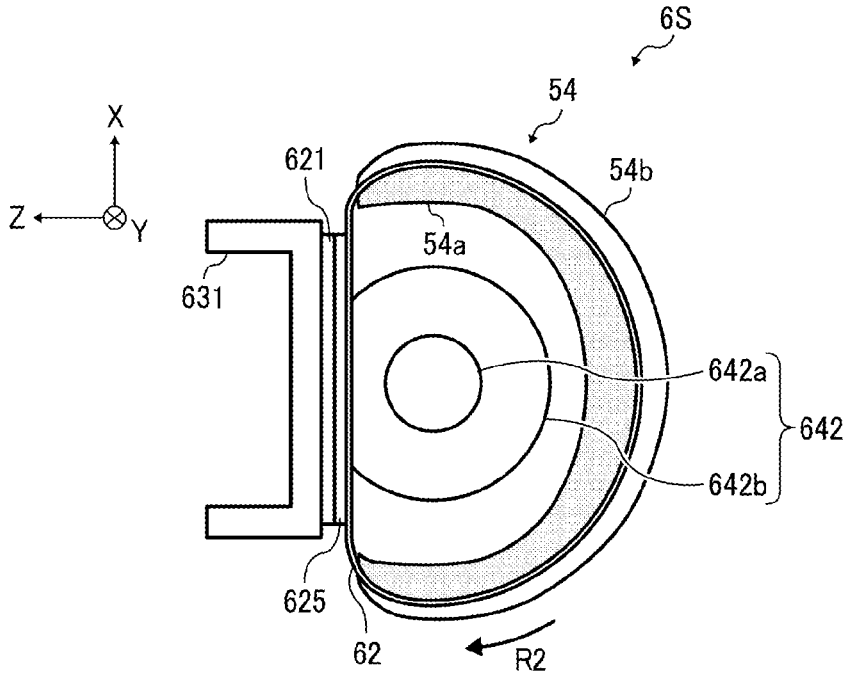
FIG. 6 is a partial vertical sectional view of the fixing device shown in FIG. 5 taken along line C'-C' in FIG. 5.

FIG. 5 is a schematic side view of the fixing device 6S. FIG. 6 is a partial vertical sectional view of the fixing device 6S taken along line C'-C' in FIG. 5. A description below is simplified by omitting illustration of components equivalent to those of the fixing device 6 depicted in FIGS. 2 to 4 and assigning the identical reference numerals to those components.

As shown in FIG. 5, the fixing device 6S includes a first fixing member 61S smaller than the second fixing member 62 in the direction Y. The first nip formation pad 621 presses against each lateral end of the second fixing member 62 in the direction Y. Since the second fixing member 62 frictionally slides over the first nip formation pad 621 via the first fixing member 61S, that is, since the slide face of the first nip formation pad 621 disposed opposite the second fixing member 62 is exerted with friction, a driving torque may not be transmitted from the driver 642 to the second fixing member 62 sufficiently, degrading rotation of the second fixing member 62.

To address this circumstance, as shown in FIG. 6, an opposed face of the first nip formation pad 621 disposed opposite the second fixing member 62, that is, the slide face over which the second fixing member 62 slides via the first fixing member 61S, is coated with a material having a decreased friction coefficient to produce a first slide portion 625 serving as a slide layer or a first slide aid that decreases friction, that is, slide resistance, between the first nip formation pad 621 and the second fixing member 62.

Alternatively, a sheet having a decreased friction coefficient may be wound around the surface of the first nip formation pad 621 to produce a slide layer between the first nip formation pad 621 and the second fixing member 62. Accordingly, the first slide portion 625 reduces slide resistance of the second fixing member 62 against the first nip formation pad 621, facilitating transmission of the driving torque from the driver 642 to the first fixing member 61S. Consequently, the first fixing member 61S and the second fixing member 62 rotate in accordance with rotation of the driver 642.

A description is provided of a construction of a fixing device 6T according to a third example embodiment.

Figure 7:
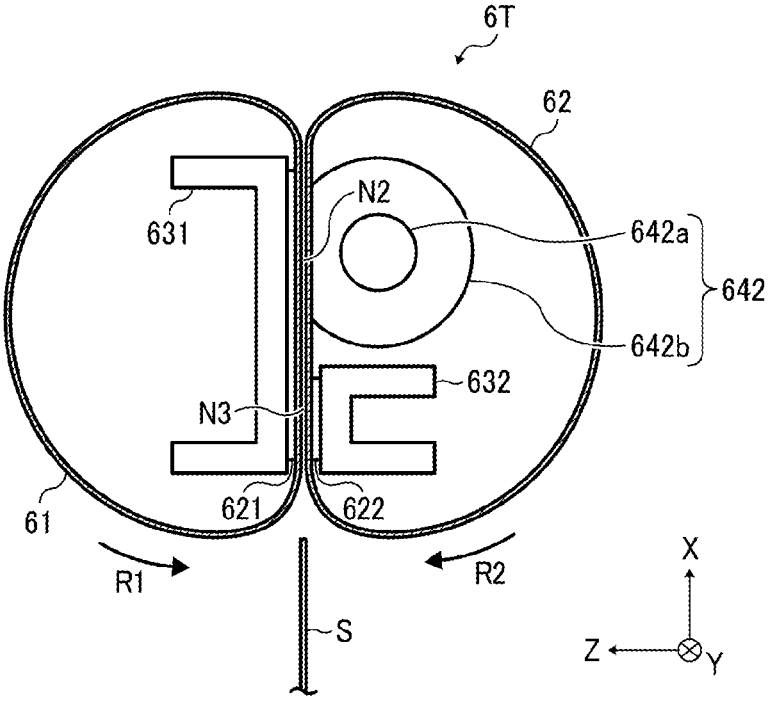
FIG. 7 is a schematic vertical sectional view of a fixing device according to a third example embodiment.

FIG. 7 is a schematic vertical sectional view of the fixing device 6T. As shown in FIG. 7, the fixing device 6T includes a second nip formation pad 622 and a second support 632. The second nip formation pad 622 serving as a second nip formation member contacts the inner circumferential surface of the second fixing member 62 to form a fixing nip N3 serving as a second fixing nip. The second support 632 contacts and supports the second nip formation pad 622.

The second nip formation pad 622 is disposed inside the loop formed by the second fixing member 62 and upstream from the driver 642 in the direction X, that is, the sheet conveyance direction such that the second nip formation pad 622 is disposed opposite the first nip formation pad 621 via the second fixing member 62 and the first fixing member 61. The fixing nip N3 is disposed upstream from and contiguous to the fixing nip N2 in the direction X. Since the shape, the material, and the like of the second nip formation pad 622 are equivalent to those of the first nip formation pad 621, a description thereof is omitted.

The second support 632 is a stainless steel support having a rigidity great enough to prevent or suppress deformation of the second nip formation pad 622 caused by a reaction force that the second nip formation pad 622 receives from the fixing nip N3. Alternatively, the second support 632 may be made of metal such as iron. The second support 632 supporting the second nip formation pad 622 in conformity with the shape of the second nip formation pad 622 serves as a fixing nip formation aid that prevents or suppresses deformation of the second nip formation pad 622.

According to this example embodiment, the second nip formation pad 622 is disposed upstream from the driver 642 in the direction X. Alternatively, the second nip formation pad 622 may be disposed downstream from the driver 642 in the direction X. However, it is preferable that the second nip formation pad 622 is disposed upstream from the driver 642 in the direction X to prevent bending of the second fixing member 62 due to friction exerted thereto that may arise if the second nip formation pad 622 is disposed downstream from the driver 642 in the direction X. Accordingly, the fixing nips N2 and N3 produced along the first nip formation pad 621 decrease shifting of the fixing nip N3 from the fixing nip N2 in the direction Z, reducing or preventing creasing and warping of the sheet S during a fixing job and image shifting of the toner image formed on the sheet S.

Other construction of the fixing device 6T according to the third example embodiment is equivalent to the construction of the fixing devices 6 and 6S according to the first and second example embodiments, respectively, and therefore a description thereof is omitted.

With reference to FIGS. 8 to 11, a description is provided of a construction of a fixing device 6U according to a fourth example embodiment.

Figure 8:
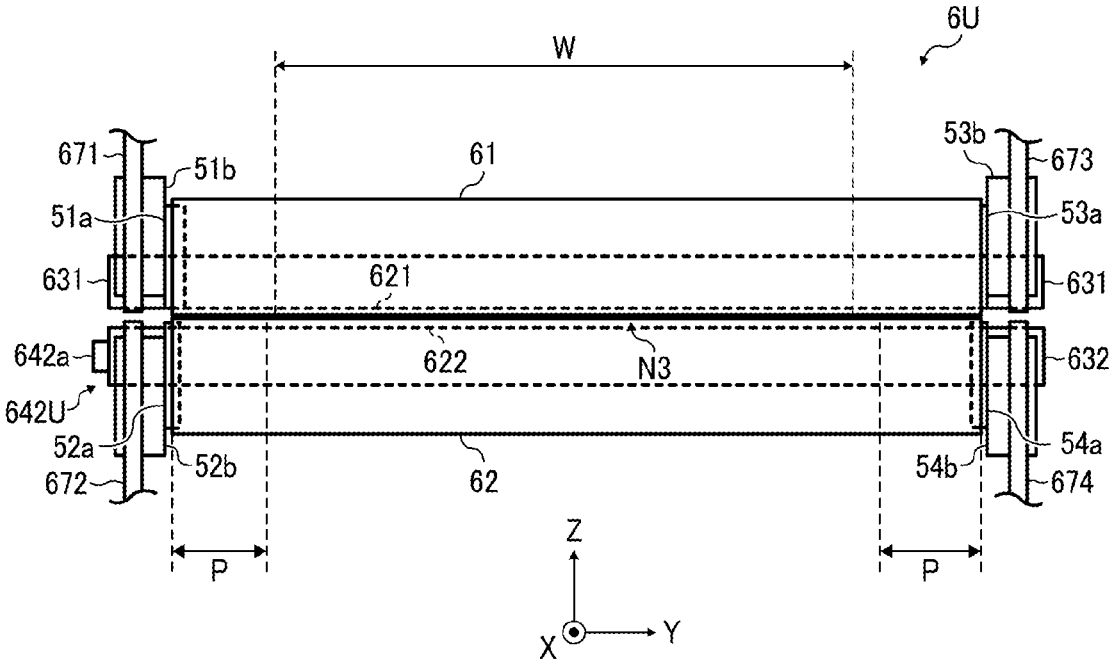
FIG. 8 is a schematic side view of a fixing device according to a fourth example embodiment.

FIG. 8 is a schematic side view of the fixing device 6U. As shown in FIG. 8, the fixing device 6U produces a driving span P in the direction Y at each lateral end thereof where a driver 642U, together with the first nip formation pad 621, sandwiches the second fixing member 62 and the first fixing member 61. The fixing device 6U further produces a fixing span W in the direction Y where the second nip formation pad 622, together with the first nip formation pad 621, forms the fixing nip N3. The fixing span W is inboard from the driving span P in the direction Y.

Figure 9:
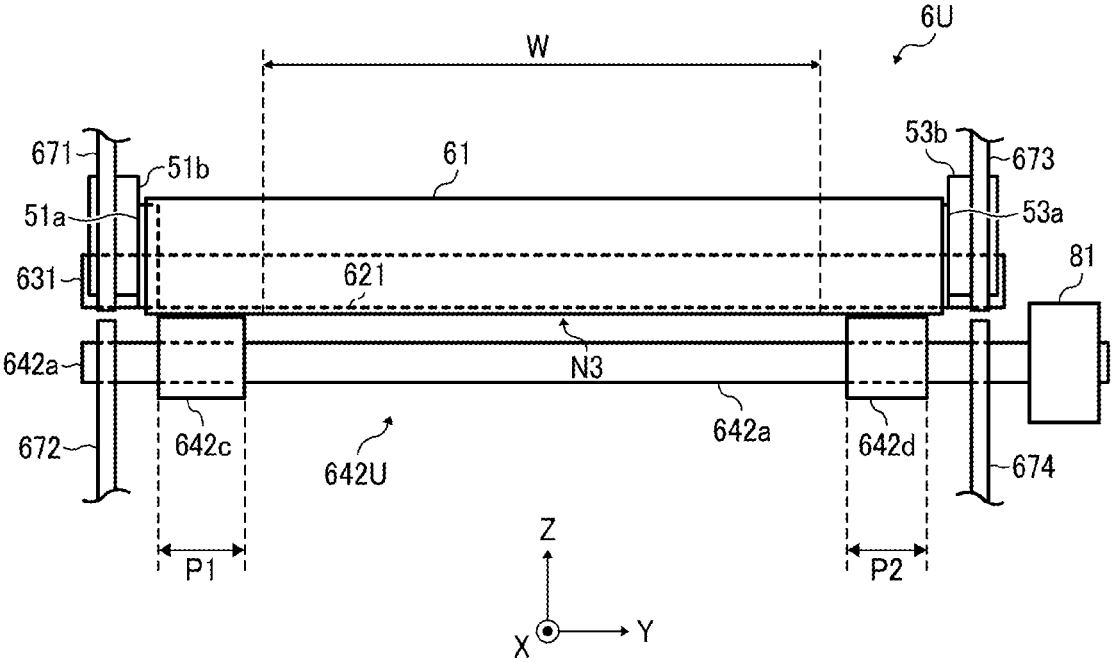
FIG. 9 is a schematic side view of the fixing device shown in FIG. 8, illustrating a driver incorporated therein.

FIG. 9 is a schematic side view of the fixing device 6U. As shown in FIG. 9, the driver 642U includes the cored bar 642*a* and elastic rollers 642*c* and 642*d*.

The elastic rollers 642*c* and 642*d* constitute a pair of elastic rollers surrounding the cored bar 642*a*. The elastic roller 642*c* is disposed upstream from the elastic roller 642*d* in the direction Y to produce a first driving span P1. The elastic roller 642*d* is disposed downstream from the elastic roller 642*c* in the direction Y to produce a second driving span P2. The elastic roller 642*c* serves as a first driver contacting the second fixing member 62 in the first driving span P1 disposed at one lateral end of the driver 642U and the second fixing member 62 in the direction Y, that is, an axial direction of the driver 642U. The elastic roller 642*d* serves as a second driver contacting the second fixing member 62 in the second driving span P2 disposed at another lateral end of the driver 642U and the second fixing member 62 in the direction Y.

FIG. 9 omits illustration of the second fixing member 62 and the like to simplify the drawing.

The fixing span W is interposed between the elastic rollers 642*c* and 642*d* to span a conveyance span where the sheet S is conveyed over the first fixing member 61 and the second fixing member 62.

The driving span P includes the first driving span P1 where the elastic roller 642*c* and the first nip formation pad 621 sandwich the second fixing member 62 and the first fixing member 61 and the second driving span P2 where the elastic roller 642*d* and the first nip formation pad 621 sandwich the second fixing member 62 and the first fixing member 61.

Figure 10:
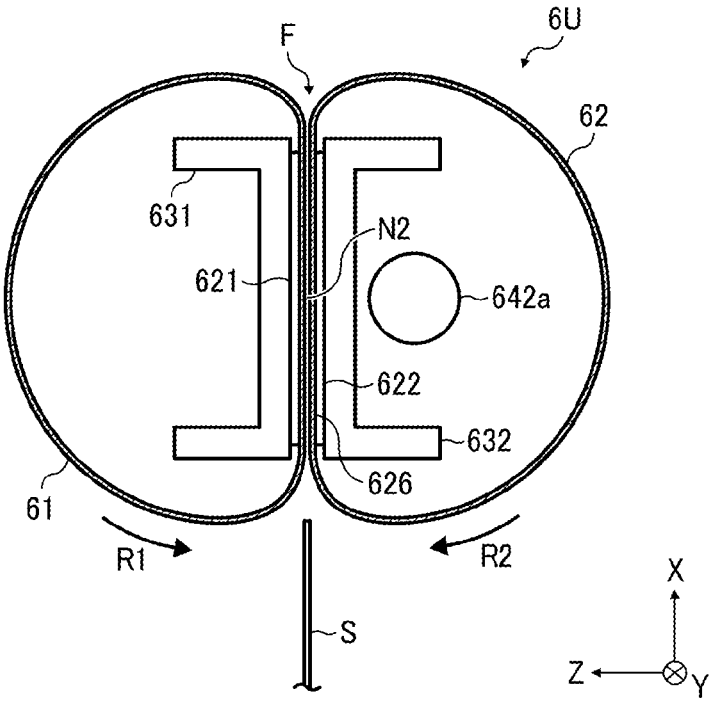
FIG. 10 is a schematic vertical sectional view of the fixing device shown in FIG. 8 in a fixing span thereof.
Figure 11:
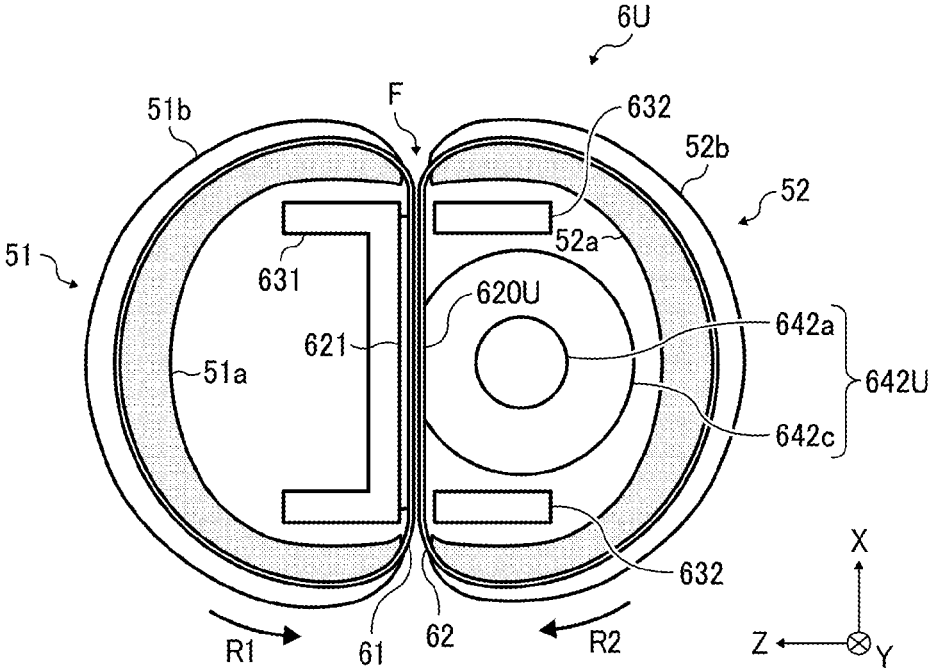
FIG. 11 is a schematic vertical sectional view of the fixing device shown in FIG. 8 in a driving span thereof.

FIG. 10 is a schematic vertical sectional view of the fixing device 6U in the fixing span W. FIG. 11 is a schematic vertical sectional view of the fixing device 6U in the second driving span P2.

The first driving span P1 and the second driving span P2 are disposed outboard from the fixing span W in the direction Y. In other words, each driving span P is disposed outboard from the fixing span W in the axial direction of the driver 642U. That is, the first driving span P1 and the second driving span P2 are produced in non-conveyance spans where the sheet S is not conveyed over the first fixing member 61 and the second fixing member 62, respectively.

Since the driver 642U drives and rotates the second fixing member 62 in the first driving span P1 and the second driving span P2 corresponding to the non-conveyance spans where the sheet S is not conveyed, respectively, the shape and the pressure distribution of the fixing nips N2 and N3 in the fixing span W are optimized flexibly while the sheet S is conveyed stably without degradation in fixing quality.

As shown in FIG. 11, the second fixing member 62 mounts a friction resistance portion 620U on the inner circumferential surface of the second fixing member 62. The friction resistance portion 620U sandwiched between the second fixing member 62 and the driver 642U spans the first driving span P1 and the second driving span P2 of the driver 642U and increases the maximum static friction against the driver 642U. The friction resistance portion 620U does not overlap the fixing span W. Accordingly, the friction resistance portion 620U increases the maximum static friction to transmit the driving torque from the driver 642U to the second fixing member 62 more effectively compared to a portion of the second fixing member 62 not provided with the friction resistance portion 620U without adversely affecting fixing quality.

Since the second fixing member 62 frictionally slides over the second nip formation pad 622, that is, since a contact face of the second nip formation pad 622 that contacts the second fixing member 62 is exerted with friction, a driving force may not be transmitted from the driver 642U to the second fixing member 62 sufficiently. To address this circumstance, as shown in FIG. 10, the second fixing member 62 further mounts a second slide aid 626 on the inner circumferential surface of the second fixing member 62 that contacts the second nip formation pad 622. The second slide aid 626 does not overlap the first driving span P1 and the second driving span P2. The second slide aid 626 is made of polyamide and serves as a slide aid that decreases a kinetic friction of the second fixing member 62 against the second nip formation pad 622. Accordingly, the second slide aid 626 coating the second fixing member 62 decreases the kinetic friction between the second nip formation pad 622 and the second fixing member 62 sliding thereover, facilitating rotation of the second fixing member 62 in accordance with rotation of the driver 642U.

The fixing device 6U may include the heater 63 situated inside the loop formed by the first fixing member 61 to heat the first fixing member 61 mainly. In this case, a temperature of the inner circumferential surface of the second fixing member 62 is lower than a temperature of the inner circumferential surface of the first fixing member 61. Accordingly, a decreased heat resistance is requested to the second fixing member 62 compared to the first fixing member 61. Hence, the material of the second slide aid 626 is selected flexibly. For example, the second slide aid 626 is made of resin having a decreased heat resistance and a decreased kinetic friction coefficient such as fluoroplastic. Thus, the second slide aid

626 mounted on the second fixing member 62 attains the heat resistance requested to the second fixing member 62 and decreases the kinetic friction between the second nip formation pad 622 and the second fixing member 62, facilitating rotation of the second fixing member 62 in accordance with rotation of the driver 642U more effectively.

As shown in FIG. 9, the cored bar 642*a* serving as a coupler couples the elastic roller 642*c* with the elastic roller 642*d* to rotate and halt the elastic roller 642*c* in synchronism with the elastic roller 642*d*. Accordingly, the elastic rollers 642*c* and 642*d* do not start driving and rotating the second fixing member 62 at different times at both lateral ends of the fixing span W in the direction Y, respectively, preventing or suppressing twist of the first fixing member 61 and the second fixing member 62.

Figure 12:
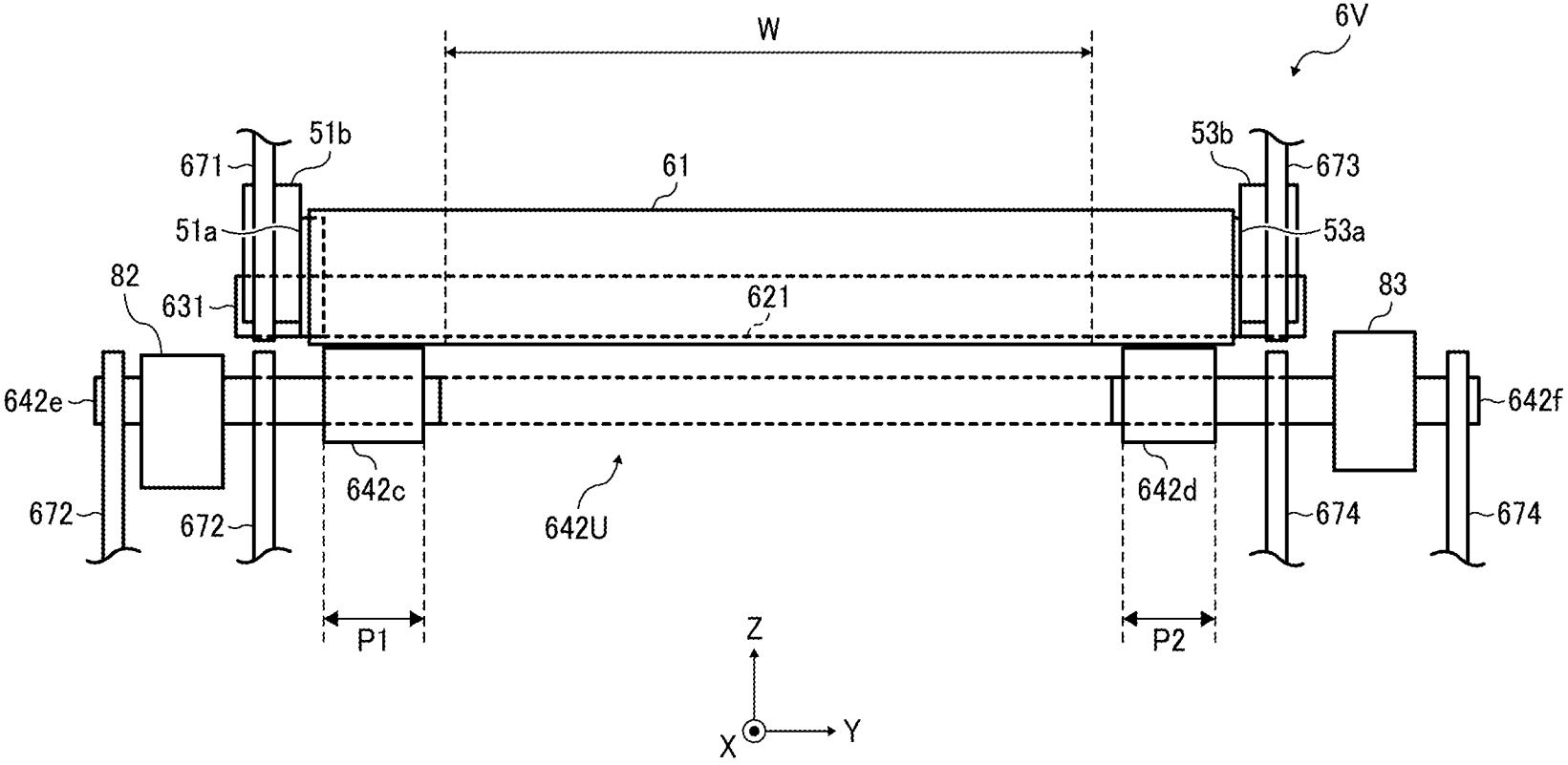
FIG. 12 is a schematic side view of a fixing device according to a fifth example embodiment.

With reference to FIG. 12, a description is provided of a construction of a fixing device 6V according to a fifth example embodiment.

FIG. 12 is a schematic side view of the fixing device 6V. As shown in FIG. 12, the fixing device 6V includes a first driving gear 82 and a first shaft 642*e* serving as a first driving assembly coupled with the elastic roller 642*c* to drive the elastic roller 642*c* and a second driving gear 83 and a second shaft 642*f* serving as a second driving assembly coupled with the elastic roller 642*d* to drive the elastic roller 642*d*. A first motor is connected to the first driving gear 82 mounted on the first shaft 642*e* to drive and rotate the elastic roller 642*c* mounted on the first shaft 642*e*. A second motor is connected to the second driving gear 83 mounted on the second shaft 642*f* to drive and rotate the elastic roller 642*d* mounted on the second shaft 642*f*. Thus, the elastic rollers 642*c* and 642*d* are driven and rotated independently or separately by the first driving assembly and the second driving assembly, respectively.

The fixing device 6V further includes a non-contact detector disposed opposite an outer circumferential surface of the second fixing member 62 at an outboard span outboard from the fixing span W in the direction Y. The outboard span on the second fixing member 62 is adhered with a component or a member having a reflectance different from a reflectance of a portion of the second fixing member 62 other than the outboard span. A light source emits a luminous flux onto the outboard span on the second fixing member 62 and the non-contact detector detects reflection light reflected by the outboard span on the second fixing member 62.

If the elastic roller 642*c* is configured to rotate in synchronism with the elastic roller 642*d*, when a rotation axis of the elastic roller 642*c* is shifted from a rotation axis of the elastic roller 642*d*, an outer circumference of the elastic roller 642*c* may not coincide with an outer circumference of the elastic roller 642*d* as the elastic rollers 642*c* and 642*d* rotate. In this case, the second fixing member 62 may be displaced in the direction Y or the like as it rotates and therefore may not convey the sheet S stably.

To address this circumstance, the rotation speed of the respective driving gears 82 and 83 is adjusted to rotate the second fixing member 62 at an identical rotation speed in the first driving span P1 and the second driving span P2, attaining stable conveyance of the sheet S. The non-contact detector detects a phase shift between the first driving span P1 and the second driving span P2. Based on the detection result, the rotation speed of the elastic roller 642*c* is adjusted separately from the rotation speed of the elastic roller 642*d*, preventing variation in the rotation speed of the second fixing member 62. For example, movement of the second fixing member 62 in the direction Y while the second fixing member 62 rotates is suppressed, preventing shifting of the fixing span W.

The present disclosure is not limited to the details of the example embodiments described above, and various modifications and improvements are possible.

For example, the detector incorporated in the fixing device 6V according to the fifth example embodiment may be a contact detector that contacts the outer circumferential surface of the second fixing member 62 to detect the phase shift between the first driving span P1 and the second driving span P2. The image forming apparatus 100 shown in FIG. 1 installed with the fixing device 6 is a color image forming apparatus that forms a color toner image on a sheet S. Alternatively, the image forming apparatus 100 may be a monochrome image forming apparatus that forms a monochrome toner image on a sheet S.

A description is provided of advantages of the fixing devices 6, 6S, 6T, 6U, and 6V.

The fixing devices 6, 6S, 6T, 6U, and 6V include an endless first belt (e.g., the first fixing member 61) to convey a recording medium (e.g., a sheet S); an endless second belt (e.g., the second fixing member 62) contacting an outer circumferential surface of the first belt; a first nip formation pad (e.g., the first nip formation pad 621) contacting an inner circumferential surface of the first belt to form a fixing nip (e.g., the fixing nips N2 and N3) between the first belt and the second belt, through which a recording medium (e.g., a sheet S) bearing a toner image is conveyed; and a driver (e.g., the drivers 642 and 642U) contacting an inner circumferential surface of the second belt to press against the first nip formation pad via the first belt and the second belt to frictionally drive and rotate the first belt and the second belt.

Accordingly, even if the pair of endless belts forms the fixing nip, the endless belts do not warp or crease, attaining stable conveyance of the recording medium and an extended life.

The advantages achieved by the fixing devices 6, 6S, 6T, 6U, and 6V are not limited to those described above.

According to the example embodiments described above, a sheet S is conveyed over a center (e.g., the fixing span W) of the first fixing member 61 in the axial direction thereof. Alternatively, a sheet S may be conveyed over the first fixing member 61 along one lateral edge of the first fixing member 61 in the axial direction thereof. In this case, the fixing span W is defined along one lateral edge of the first fixing member 61 in the axial direction thereof. Accordingly, a non-conveyance span on the first fixing member 61 is defined by another lateral edge of the first fixing member 61 in the axial direction thereof.

According to the example embodiments described above, the first fixing member 61, that is, a fixing belt, serves as an endless first belt. Alternatively, a fixing film, a fixing sleeve, or the like may be used as an endless first belt.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A fixing device comprising:

a rotatable, endless first belt;

a rotatable, endless second belt contacting an outer circumferential surface of the first belt;

a first nip formation pad contacting an inner circumferential surface of the first belt to form a fixing nip between the first belt and the second belt, the fixing nip configured to convey therethrough a recording medium bearing a toner image;

a second nip formation pad contacting an inner circumferential surface of the second belt to support the second belt; and a rotatable driver configured to, contact the inner circumferential surface of the second belt to press against the first nip formation pad via the first belt and the second belt, to frictionally drive and rotate the first belt and the second belt, and press the second belt against the first nip formation pad to define a driving span in an axial direction of the rotatable driver, wherein the second nip formation pad is configured to press against the first nip formation pad to define a fixing span in the axial direction of the rotatable driver where the recording medium is conveyed, and the driving span is outboard from the fixing span in the axial direction of the rotatable driver.

2. The fixing device of claim 1, further comprising:

a frictional resistance portion between the second belt and the rotatable driver to increase a maximum static friction between the second belt and the rotatable driver.

3. The fixing device of claim 2, wherein the frictional resistance portion does not overlap the fixing span.

4. The fixing device of claim 1, further comprising:

a first slide aid between the first nip formation pad and the second belt to decrease a friction between the first nip formation pad and the second belt, wherein the first nip formation pad extends beyond the first belt in an axial direction to contact the second belt.

5. The fixing device of claim 1, further comprising;

a second slide aid between the second belt and the second nip formation pad to decrease a kinetic friction of the second belt against the second nip formation pad.

6. The fixing device of claim 1, wherein the driving span includes, a first driving span at one lateral end of the rotatable driver in the axial direction thereof, and a second driving span at another lateral end of the rotatable driver in the axial direction thereof, and the rotatable driver includes, a first driver contacting the second belt in the first driving span, and a second driver contacting the second belt in the second driving span.

7. The fixing device of claim 6, wherein each of the first driver and the second driver includes an elastic roller.

8. The fixing device of claim 6, wherein the rotatable driver further includes, a coupler configured to couple the first driver with the second driver, the coupler configured to rotate the first driver in synchronization with the second driver.

9. The fixing device of claim 8, wherein the coupler includes a cored bar.

10. The fixing device of claim 6, further comprising:

a first driving assembly coupled with the first driver to rotate the first driver; and a second driving assembly coupled with the second driver to rotate the second driver, the second driving assembly configured to rotate the second driver separately from the first driver.

11. The fixing device of claim 1, wherein the first driving assembly includes, a first shaft mounting the first driver, and a first driving gear mounted on the first shaft; and the second driving assembly includes, a second shaft mounting the second driver, and a second driving gear mounted on the second shaft.

12. An image forming apparatus comprising:

a fixing device including, a rotatable, endless first belt, a rotatable, endless second belt contacting an outer circumferential surface of the first belt, a first nip formation pad contacting an inner circumferential surface of the first belt to form a fixing nip between the first belt and the second belt, the fixing nip configured to convey there through a recording medium bearing a toner image, a second nip formation pad contacting an inner circumferential surface of the second belt to support the second belt, and a rotatable driver configured to, contact the inner circumferential surface of the second belt to press against the first nip formation pad via the first belt and the second belt, to frictionally drive and rotate the first belt and the second belt, and press the second belt against the first nip formation pad to define a driving span in an axial direction of the rotatable driver, wherein the second nip formation pad is configured to press against the first nip formation pad to define a fixing span in the axial direction of the rotatable driver where the recording medium is conveyed, and the driving span is outboard from the fixing span in the axial direction of the rotatable driver.

13. The image forming apparatus of claim 12, further comprising:

a frictional resistance portion between the second belt and the rotatable driver to increase a maximum static friction between the second belt and the rotatable driver.

14. The image forming apparatus of claim 13, wherein the frictional resistance portion does not overlap the fixing span.

15. The image forming apparatus of claim 12, further comprising:

a first slide aid between the first nip formation pad and the second belt to decrease a friction between the first nip formation pad and the second belt, wherein the first nip formation pad extends beyond the first belt in an axial direction to contact the second belt.

16. The image forming apparatus of claim 12, further comprising:

a second slide aid between the second belt and the second nip formation pad to decrease a kinetic friction of the second belt against the second nip formation pad.

17. The image forming apparatus of claim 12, wherein the driving span includes, a first driving span at one lateral end of the rotatable driver in the axial direction thereof, and a second driving span at another lateral end of the rotatable driver in the axial direction thereof, and the rotatable driver includes, a first driver configured to contact the second belt in the first driving span, and a second driver configured to contact the second belt in the second driving span.

18. The image forming apparatus of claim 17, wherein each of the first driver and the second driver includes an elastic roller.

19. The image forming apparatus of claim 17, wherein the rotatable driver further includes, a coupler configured to couple the first driver with the second driver, the coupler configured to rotate the first driver in synchronism with the second driver.

20. The image forming apparatus of claim 17, further comprising:

a first driving assembly coupled with the first driver to rotate the first driver; and a second driving assembly coupled with the second driver to rotate the second driver, the second driving assembly configured to rotate the second driver separately from the first driver.

* * * * *